United States Patent [19]

Braun et al.

[11] 3,994,682

[45] Nov. 30, 1976

[54] TWO-STEP WASHING METHOD FOR TEXTILES

[75] Inventors: Hans Braun, Bensheim-Auerbach; Hans Kraus, Egelsbach, both of Germany

[73] Assignee: Röhm GmbH, Darmstadt, Germany

[22] Filed: June 26, 1975

[21] Appl. No.: 590,575

[30] Foreign Application Priority Data

June 29, 1974 Germany ..... 2431391

[52] U.S. Cl. ..... 8/137

[51] Int. Cl.[2] ..... D06L 1/16

[58] Field of Search ..... 8/137

[56] References Cited

FOREIGN PATENTS OR APPLICATIONS

| | | | |
|---|---|---|---|
| 1,430,557 | 3/1965 | France | 8/137 |
| 1,050,298 | 2/1959 | Germany | 8/137 |
| 916,555 | 1/1963 | United Kingdom | 8/137 |

OTHER PUBLICATIONS

Neary, J. et al. *American Dyestuff Reporter* Aug. 26, 1957 pp. P625–P632.

Cohen, S. et al. *American Dyestuff Reporter*, vol. 47, No. 10, May 19, 1958 pp. 325–328.

Schuelke, A.F. ed. *Modern Spotting*, 1961 pp. 99–102.

Fligor, A. et al. *The Spotting Manual* N.Y. 1945 pp. 131–132.

*Primary Examiner*—Joseph L. Schofer
*Assistant Examiner*—Maria S. Tungol
*Attorney, Agent, or Firm*—Donald R. Bentz

[57] ABSTRACT

A two-step method for washing textiles which comprises washing said textiles in a first step with an aqueous bath containing both a cationic surface-active agent and a non-ionogenic surface-active agent, and then washing said textiles in a second step with an aqueous bath containing conventional builders and an anionic surface-active agent, a non-ionogenic surface-active agent, or both.

2 Claims, No Drawings

TWO-STEP WASHING METHOD FOR TEXTILES

The present invention relates to a method for washing textiles. More in particular, the invention relates to a two-step method for laundering textiles in which, in the first step, the textiles are treated in a bath containing a cationically-active surface-active agent and, in the second step, are treated in a bath containing an anion-active and/or non-ionogenic surface-active agent as well as with conventional builders.

In practice, textiles are now to a greatly predominant extent washed in two stages, which are characterized as the "pre-wash" and "clear wash". In both stages, anion-active and/or non-ionogenic surface-active agents are present. In the pre-wash, the main portion of the dirt, which only weakly adheres to the fibers, is removed. The clear wash dissolves the tightly-adherent dirt.

It is already known from German Auslegeschrift No. 1,050,298 to employ cation-active surface-active agents in the pre-wash and to employ anionic-active surface-active agents in the principal wash cycle, or vice versa. In the clear wash, the dirt is electrically charged with a charge opposite to that imparted in the pre-wash, which technique is said to facilitate a loosening of dirt from the textile fibers. However, the process has achieved no practical significance.

German Offenlegungsschrift No. 2,052,881 proposes a combination of anion-active, cation-active, and — optionally — also non-ionogenic surface-active agents for the washing of wool. The cationic-active surface-active agents can also be permitted to act on the wool in a separate bath before the other components.

In contrast to these known methods, the two-step process according to the invention employs cationic-active and non-ionogenic surface-active agents in combination in the pre-wash stage, whereby a surprising increase in efficacy is elicited. The process of the invention is carried out with particular success using surface-active agents whose hydrophobic portion consists of straight-chain alkyl groups having from 10 – 18 carbon atoms.

In the combination according to the present invention, the cationic-active and non-ionogenic surface-active agents cooperate synergistically, as is evident from comparative washings of artificially-dirtied test fabrics of cotton or of a cotton polyester mixture. The test fabrics were subjected to a prewash with cationically-active surface-active agents alone or with the combination according to the present invention of a cationically-active and a non-ionogenic surface-active agent. Subsequently, the clear wash was carried out with different commercially-available anionic and non-ionogenic laundering agents. The tests showed that the combination of the present invention is clearly superior as measured by the remission values of the treated fabrics.

Organic primary, secondary, or tertiary amines or their salts or quaternary ammonium salts having at least one hydrophobic portion are suitable as the cationically-active surface-active agents for the first stage. The hydrophobic groups can be a higher alkyl, a benzyl, or alkyl phenyl group. A straight-chain saturated alkyl group having from 8 – 20 carbon atoms is preferred. The acid anion can be derived from a low molecular weight organic carboxylic acid such as acetic acid, or from inorganic mineral acids such as hydrochloric acid.

Examples of suitable cationic surface-active agents are coconut fatty amine acetate, trimethyl dodecyl ammonium chloride, trimethyl octadecyl ammonium chloride, trimethyl hydrotalgalkyl ammonium chloride, dimethyl dodecyl benzyl ammonium chloride, N-dodecyl pyridinium chloride, N-methyl-N-dodecyl morpholinium chloride, and dimethyl octadecyl ethanol ammonium chloride.

The non-ionogenic surface-active agents which are employed together with the cationically-active agents are preferably condensation products of ethylene oxide and a hydrophobic compound having at least one active hydrogen atom, for example fatty alcohols, alkyl phenols, fatty acids, fatty acid amides, or fatty amines. Here also, saturated alkyl groups having from 8 – 20 carbon atoms or alkyl phenyl groups having from 6 – 14 carbon atoms in the alkyl portion are preferred as hydrophobic groups. The adducts as a rule contain from 3 – 30 and, preferably, from 5 – 12 ethylene oxide groups per molecule.

Also, those water-soluble polyethylene oxide adducts containing from 20 – 300 ethylene glycol ether groups and from 10 – 120 propylene glycol ether groups on propylene glycol, ethylene diamino polypropylene glycol, and alkyl polypropylene glycols having up to 12 carbon atoms in the alkyl chain, as well as non-ionic compounds of the sulfoxide and amine oxide types can be employed as non-ionogenic agents. The foaming properties can be varied by combinations of suitable surface-active agents.

In the first washing step, both the cationically-active surface-active agent and the non-ionogenic agent are used in an amount of from 0.1 to 2 grams per liter of wash water. The washing time can, for example, be from 5 – 30 minutes at 50° – 90° C. A considerable removal of dirt is neither sought for nor achieved by this process. Rather, the dirt particles are brought into a condition in which they are particularly easily removable in the main washing step.

The pre-wash agents according to the present invention suitably contain graying inhibitors which combat the fixation from out of the bath of the dirt removed from the fibers. Materials such as sodium cellulose glycolate, glue, gelatin, salts of ether carboxylic acids, ether sulfonic acids of starch or of cellulose, as well as salts of acid sulfuric acid esters are agents of this type. Also, synthetic polymers of water-soluble vinyl compounds, specially intended for synthetic fibers, can be used. Suspending agents, particularly polymeric phosphates, need not be employed in this stage.

The second washing step as a rule follows the first wash after removal of the first bath, without any intermediate rinsing. In the second step, or clear wash step, conventional anionically-active or non-ionically active washing agents are employed in amounts of from 3 – 10 grams per liter. The wash temperature is usually between 50° and 90° C.

Suitable anionically-active surface-active agents are soaps and the known surface-active agents of the sulfonate and sulfate type having aliphatic, cycloaliphatic, or fatty aromatic groups. The non-ionogenic surface agents mentioned above for use in the first washing step can also be used in the second stage, alone or in combination with other materials. In the second washing step all of the usual components of customary laundering agents can be used, including, in particular, builders such as phosphates, silicates, and perborates, as well as dirt carriers, foam stabilizers, disinfectants, optical brighteners, perfumes, and coloring agents.

The process of the invention can be used to wash textiles of all types, for example those of cotton, wool, and synthetic fibers. It is equally suitable for machine washing as well as for hand washing. The washing agents for the first and the second washing step can be stored and handled in powder form or as a paste or liquid.

In addition to the good washing results, the new process is characterized by a detectable decrease in pollution of the waste water. It is well known that materials used as builders, in particular phosphates, do lead to considerable problems if they are deposited with the waste water in rivers and lakes. The possibility afforded by the invention of avoiding builders in the first wash step results in a detectable improvement in the quality of the waste water.

A better understanding of the present invention and of its many advantages will be had by referring to the following specific examples, given by way of illustration. In the Examples, fabric test strips 9 × 20 cm in size were employed for the washing tests. In each case, a dirtied strip was washed with a clean piece of fabric in order to ascertain redeposition. The test strips were dirtied by saturation with motor oil previously used for 75 hours in a diesel engine. After excess oil had dripped off and the strips had been dried with filter paper, the fabrics were heated for 2 hours at 110° C. The hardness of the wash water was about 14° on the German scale.

The following washing agents were employed (all parts are by weight):

1. a cation active pre-wash agent
   57 parts coconut fatty amine acetate
   29 parts sodium metasilicate
   14 parts carboxymethylcellulose
2. a cation-active + non-ionogenic pre-wash agent
   28 parts coconut fatty amine acetate
   29 parts dodecanol polyglycol ether (9 mols of ethylene oxide)

29 parts sodium metasilicate
   14 parts carboxymethylcellulose
3. washing agent I (calculated as dry material)
   5.5 parts alkyl benzene sulfonate
   3.9 parts fatty alcohol ethoxylate
   2.5 parts soap
   39.2 parts sodium phosphate
   2.8 parts sodium carbonate 10.7 parts sodium sulfate
   4.6 parts magnesium silicate
   13.8 parts sodium perborate
   17 parts water
4. washing agent II
   6.9 parts alkyl benzene sulfonate
   2.0 parts fatty alcohol oxyethylate
   3.0 parts soap
   30.3 parts sodium phosphate
   1.7 parts sodium carbonate 8.6 parts sodium sulfate
   4.5 parts sodium silicate
   25.0 parts sodium perborate
   18.0 parts water The Washing temperature was 50° C. in the pre-wash and 60° C. in the clear wash. The washing time was 20 minutes. No intermediate rinsing was performed between the two washing steps.

The remission values, measured with a ELREPHO photometer (Carl Zeiss) employing a No. 6 filter, show that by the use of a cation-active pre-washing agent according to the invention, considerably better values were obtained in all tests although only ⅓ of the usual amount of laundering agent was employed for the pre-wash. In the following tables, R is a measure of the photometrically-determined remission on illumination with visible light. RE is a measure of remission and elimination on illumination with visible and ultraviolet light, the latter being transformed into visible light by optical brighteners.

TABLE I

WASH RESULTS

Fabric: Polyester/cotton 65/35, 215 g/m²
46 g/m² dirt-loading with old oil

| WASHING AGENT | AMOUNT (g/l) | PRE-DIRTIED FABRIC R | PRE-DIRTIED FABRIC RE | CLEAN FABRIC R | CLEAN FABRIC RE |
|---|---|---|---|---|---|
| Sample fabric | — | 7.2 | 7.0 | 79.9 | 99.4 |
| Pre-wash: cation-active + non-ionogenic | 1.25 | | | | |
| Main wash: washing agent I | 5.0 | 50.6 | 59.4 | 74.7 | 88.5 |
| Pre-wash: cation-active | 1.25 | | | | |
| Main wash: washing agent I | 5.0 | 40.2 | 49.3 | 75.1 | 87.9 |
| Pre-wash: washing agent I | 5.0 | | | | |
| Main wash: washing agent I | 5.0 | 26.2 | 25.6 | 72.7 | 89.6 |
| Pre-wash: cation-active + non-ionogenic | 1.25 | | | | |
| Main wash: washing agent II | 5.0 | 37.7 | 43.3 | 72.3 | 87.9 |
| Pre-wash: cation-active | 1.25 | | | | |
| Main wash: washing agent II | 5.0 | 32.3 | 38.1 | 72.3 | 88.2 |
| Pre-wash: washing agent II | 5.0 | | | | |
| Main wash: washing agent II | 5.0 | 24.4 | 23.7 | 74.3 | 92.1 |

TABLE II

Fabric: Cotton 174 g/m²
56 g/m² dirt-loading with old oil

| WASHING AGENT | AMOUNT (g/l) | PRE-DIRTIED FABRIC R | PRE-DIRTIED FABRIC RE | CLEAN FABRIC R | CLEAN FABRIC RE |
|---|---|---|---|---|---|
| Sample fabric | — | 8.6 | 7.2 | 82.2 | 79.6 |
| Pre-wash: cation-active + non-ionogenic | 1.25 | | | | |

TABLE II-continued

Fabric: Cotton 174 g/m²
56 g/m² dirt-loading with old oil

| WASHING AGENT | AMOUNT (g/l) | PRE-DIRTIED FABRIC R | PRE-DIRTIED FABRIC RE | CLEAN FABRIC R | CLEAN FABRIC RE |
|---|---|---|---|---|---|
| Main wash: washing agent I | 5.0 | 47.8 | 47.8 | 82.4 | 97.2 |
| Pre-wash: cation-active | 1.25 | | | | |
| Main wash: washing agent I | 5.0 | 41.2 | 41.9 | 82.6 | 97.0 |
| Pre-wash: washing agent I | 5.0 | | | | |
| Main wash: washing agent I | 5.0 | 34.0 | 38.1 | 82.3 | 99.4 |
| Pre-wash: cation-active + non-ionogenic | 1.25 | | | | |
| Main wash: washing agent II | 5.0 | 40.3 | 40.3 | 80.3 | 92.4 |
| Pre-wash: cation-active | 1.25 | | | | |
| Main wash: washing agent II | 5.0 | 36.9 | 37.0 | 79.8 | 92.8 |
| Pre-wash: washing agent II | 5.0 | | | | |
| Main wash: washing agent II | 5.0 | 35.2 | 45.3 | 81.3 | 96.9 |

What is claimed is:

1. A two-step method for washing textiles which consists of washing said textiles in a first step with an aqueous bath containing both a cationic surface-active agent and a non-ionogenic surface-active agent, and then washing said textiles in a second step with an aqueous bath containing conventional builders and an anionic surface-active agent, a non-ionogenic surface-active agent, or both.

2. A method as in claim 1 wherein said cationic surface-active agent is a salt of a primary aliphatic amine having a hydrophobic group.

* * * * *